United States Patent [19]

Krishnamurthy

[11] Patent Number: 4,740,438

[45] Date of Patent: Apr. 26, 1988

[54] ORGANIC DISULFIDES AS IMAGE DYE STABILIZERS

[75] Inventor: Sundaram Krishnamurthy, Penfield, N.Y.

[73] Assignee: Eastman Kodak Company, Rochester, N.Y.

[21] Appl. No.: 940,877

[22] Filed: Dec. 10, 1986

[51] Int. Cl.[4] ..... G03C 1/40; G03C 7/36

[52] U.S. Cl. ..... 430/17; 430/372; 430/551; 430/611

[58] Field of Search ..... 430/551, 611, 372, 17

[56] References Cited

U.S. PATENT DOCUMENTS

| | | | |
|---|---|---|---|
| 2,756,145 | 7/1956 | Ballard et al. | 430/611 |
| 3,397,986 | 8/1968 | Millikan et al. | 430/551 |
| 3,507,658 | 4/1970 | Dersch et al. | 430/611 |
| 3,761,277 | 9/1973 | Vandenberghe et al. | 430/611 |
| 4,549,015 | 10/1985 | Howell | 544/87 |

FOREIGN PATENT DOCUMENTS 1547302 6/1979 United Kingdom .

OTHER PUBLICATIONS

Research Disclosure 11133, Jul. 1973, "Interimage Effects in Photographic Color Elements".

*Primary Examiner*—Richard L. Schilling
*Attorney, Agent, or Firm*—Harold E. Cole

[57] ABSTRACT

Photographic stabilizers comprising certain organic disulfide compounds are described for incorporation in photographic emulsions and elements. The compounds are preferably employed in the magneta layer to protect the magneta dye from fading by light.

20 Claims, No Drawings

ORGANIC DISULFIDES AS IMAGE DYE STABILIZERS

This invention relates to photographic image dye stabilizers and to silver halide photographic elements employing such stabilizers. In a particular aspect, it relates to stabilizers comprising certain organic disulfides.

Images are commonly obtained in the photographic art by a coupling reaction between the development product of a silver halide color developing agent (i.e., oxidized aromatic primary amino developing agent) and a color forming compound commonly referred to as a coupler. The dyes produced by coupling are indoaniline, azomethine, indamine or indophenol dyes, depending upon the chemical composition of the coupler and the developing agent. The subtractive process of color formation is ordinarily employed in multicolor photographic elements and the resulting image dyes are usually cyan, magenta and yellow dyes which are formed in or adjacent to silver halide layers sensitive to radiation complementary to the radiation absorbed by the image dye; i.e. silver halide emulsions sensitive to red, green and blue radiation.

The patent and technical literature is replete with references to compounds which can be used as couplers for the formation of photographic images. Preferred couplers which form cyan dyes upon reaction with oxidized color developing agents are phenols and naphthols. Representative couplers are described in the following patents and publications: U.S. Pat. Nos. 2,772,162, 2,895,826, 3,002,836, 3,034,892, 2,474,293, 2,423,730, 2,367,531, 3,041,236, 4,333,999 and "Farbkuppler-eine Literaturubersicht," published in Agfa Mitteilungen, Band II, pp. 156–175 (1961).

Preferred couplers which form magenta dyes upon reaction with oxidized color developing agent are pyrazolones, pyrazolotriazoles, pyrazolobenzimidazoles and indazolones. Representative couplers are described in such patents and publications as U.S. Pat. Nos. 2,600,788, 2,369,489, 2,343,703, 2,311,082, 2,673,801, 3,152,896, 3,519,429, 3,061,432, 3,062,653, 3,725,067, 2,908,573 and "Farbkuppler-eine Literaturubersicht," published in Agfa Mitteilungen, Band II, pp. 126–156 (1961). Two-equivalent magenta couplers are disclosed in U.S. Pat. Nos. 3,419,391, 3,725,067, 4,351,897, 4,436,808 and 4,443,536, the disclosures of which are hereby incorporated by reference.

Couplers which form yellow dyes upon reaction with oxidized color developing agent are acylacetanilides such as benzoylacetanilides and pivalylacetanilides. Representative couplers are described in the following patents and publications: U.S. Pat. Nos. 2,875,057, 2,407,210, 3,265,506, 2,298,443, 3,048,194, 3,447,928 and "Farbkuppler-eine Literaturubersicht," published in Agfa Mitteilungen, Band II, pp. 112–126 (1961).

When intended for incorporation in photographic elements, couplers are commonly dispersed therein with the aid of a high boiling organic solvent, referred to as a coupler solvent. Couplers are rendered nondiffusible in photographic elements, and compatible with coupler solvents, by including in the coupler molecule a group referred to as a ballast group. This group normally is located on the coupler in a position other than the coupling position and imparts to the coupler sufficient bulk to render the coupler nondiffusible in the element as coated and during processing. It will be appreciated that the size and nature of the ballast group will depend upon the bulk of the unballasted coupler and the presence of other substituents on the coupler.

British Pat. No. 1,547,302 describes the stabilization of magenta dye images by the use of a chromanol compound and a phenolic stabilizer. One of the phenolic compounds is a bis-phenol in which two phenol rings are linked through a bridging group, one of which includes a disulfide. Other disulfide compounds employed as stabilizers in silver halide emulsions are described in U.S. Pat. Nos. 3,761,277, 3,397,986 and 4,549,015. Research Disclosure 11133, July, 1973 discloses various compounds which have useful interimage effects, including one disulfide compound.

It would be desirable to provide a new class of disulfide compounds useful as stabilizers in color photographic materials, particularly those incorporating 2-equivalent magenta couplers, which would stabilize the photographic dye image from fading by light and which would have a low yellow background stain.

These and other objects are achieved in accordance with the invention which comprises a photographic element comprising a support having thereon at least one silver halide emulsion layer having associated therewith a dye-forming coupler and a stabilizer compound having the formula:

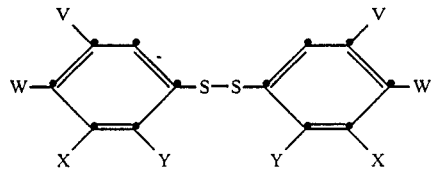

wherein each V, W, X and Y independently represents $R^1$, nitro, halogen, cyano, OR, SR, $NR^1R$, COR, COOR, $SO_3R$, $SO_2R$, NHCOR, $CONR^1R$, $NR^1SO_2R$, or $SO_2NR^1R$, or X or W can join together with an adjacent substituent to form a ring;

R represents a substituted or unsubstituted alkyl group of from 1 to about 20 carbon atoms, such as methyl, trifluoromethyl, ethyl, isopropyl, isohexyl, sec-butyl, sec-heptyl, dodecyl, 2-hydroxyethyl, carbomethoxymethyl, allyl, benzyl, 2-chloroethyl, etc.; a substituted or unsubstituted aryl group of from about 5 to about 20 carbon atoms, such as phenyl, 4-methoxyphenyl, 2,4-dichlorophenyl or naphthyl; cycloalkyl such as cyclopropyl, 4-methylcyclohexyl, cyclobutyl, cyclohexyl or cycloheptyl; or a substituted or unsubstituted heterocyclic group having from 3 to about 10 carbon atoms such as furyl, thienyl, pryidyl, N-methylpyrrolyl, tetrahydro-furfuryl or N-ethyl indolyl; and $R^1$ represents hydrogen or R;

with the proviso that the total number of carbon atoms within all V, W, X and Y groups combined is at least 4, and with the further proviso that at least one Y group is not hydrogen.

In a preferred embodiment of the invention, the dye-forming coupler forms a magenta dye upon reaction with oxidized color developing agent, the coupler being a pyrazolone or a pyrazolotriazole.

In another preferred embodiment of the invention, Y is OR wherein R is substituted or unsubstituted alkyl of from 1 to about 20 carbon atoms.

In yet another preferred embodiment of the invention, Y is substituted or unsubstituted alkyl of from 1 to about 20 carbon atoms.

In still another preferred embodiment of the invention, Y is NHCOR or COOR.

In still yet another preferred embodiment of the invention, each V, W or X is either hydrogen or alkyl.

Preferred compounds included within the scope of the invention include the following:

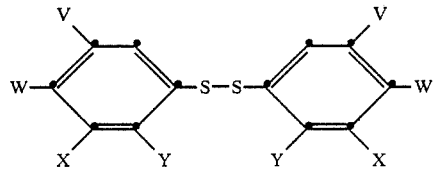

| Compound | V | W | X | Y |
|---|---|---|---|---|
| 1 | $C_8H_{17}$-t | H | H | $OC_4H_9$ |
| 2 | $C_3H_7$-i | H | H | $C_3H_7$-i |
| 3 | H | $C_5H_{11}$-t | H | $C_5H_{11}$-t |
| 4 | H | H | H | $NHCOC_{11}H_{23}$ |
| 5 | H | H | H | $NHCOCH(C_2H_5)C_4H_9$ |
| 6 | H | H | H | $NHCOC_4H_9$-t |
| 7 | H | H | H | $NHCOC_6H_5$ |
| 8 | H | H | H | $COOC_{12}H_{25}$ |
| 9 | H | H | H | 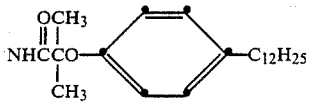 |
| 10 | H | H | H | 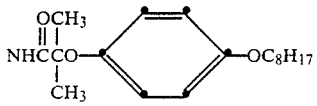 |
| 11 | H | H | H | 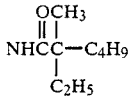 |
| 12 | H | $C_3H_7$-i | H | $C_3H_7$-i |
| 13 | H | H | H | $NHSO_2C_4H_9$ |
| 14 | $C_{15}H_{31}$ | H | H | $C_4H_9$-t |
| 15 | H | H | H | $C_6H_5$ |
| 16 | H | H | H | 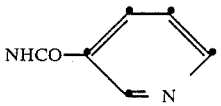 |
| 17 | H | H | H | $CH_2C_6H_5$ |

The above compounds may be synthesized, for example, by heating a dimethyl sulfoxide solution of a desired thiophenol.

The stabilizer compounds of this invention can be used in any concentration which is effective for the intended purpose. Generally, good results can be obtained using concentrations ranging from 10 to 150 mg/m$^2$, preferably from 30 to 120 mg/m$^2$.

Typically, the stabilizer compound and coupler are incorporated in a silver halide emulsion and the emulsion coated on a support to form a photographic element. Alternatively, the stabilizer compound and coupler can be incorporated in photographic elements adjacent to the silver halide emulsion where, during development, the coupler will be in reactive association with development products such as oxidized color developing agent. Thus, as used herein, the term "associated therewith" signifies that the stabilizer and coupler are in the silver halide emulsion layer or in an adjacent location where, during processing, they will be capable of reacting with silver halide development products.

Photographic elements of the invention can be single color elements or multicolor elements. Multicolor elements contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982.

A typical multicolor photographic element of the invention comprises a support having thereon a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler, at least one of the couplers in the element containing a stabilizer compound of this invention. The element can contain additional layers, such as filter layers, interlayers, overcoat layers, subbing layers, and the like.

Another aspect of the invention relates to a process of stabilizing a photographic dye image against fading by light comprising processing a photographic element as described above. The specific processing steps which are used are described hereinafter. Still another aspect of the invention relates to a processed photographic element, i.e., a print, comprising a support having thereon a dye image and a stabilizer as described above.

In the following discussion of suitable materials for use in the emulsions and elements of this invention, reference will be made to *Research Disclosure,* December 1978, Item 17643, published by Industrial Opportunities Ltd., Homewell Havant, Hampshire, PO9 1EF, U.K., the disclosures of which are incorporated herein by reference. This publication will be identified hereafter by the term "Research Disclosure".

The silver halide emulsions employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the couplers generally described above, the elements of the invention can include additional couplers as described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof, can contain brighteners (see Research Disclosure Section V), antifoggants and stabilizers (see Research Disclosure Section VI), antistain agents and image dye stabilizers (see Research Disclosure Section VII, paragraphs I and J), light absorbing and scattering materials (see Research Disclosure Section VIII), hardeners (see Research Disclosure Section XI), plasticizers and lubricants (see Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents useful in the invention are p-phenylene diamines. Especially preferred are 4-amino-3-methyl-N,N-diethylaniline hydrochloride, 4-amino-3-methyl-N,N-diethylaniline hydrochloride, 4-amino-3-methyl-N-ethyl-N-β-(methanesulfonamido)ethylaniline sulfate hydrate, 4-amino-3-methyl-N-ethyl-N-β-hydroxyethylaniline sulfate, 4-amino-3-β-(methane-sulfonamido)-ethyl-N,N-diethylaniline hydrochloride and 4-amino-3-methyl-N-ethyl-N-(2-methoxyethyl)anilinedi-p-toluenesulfonic acid.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The following examples are included for a further understanding of this invention.

EXAMPLE 1

Preparation of Compound 1

A solution of 10 g (34 mmol) 2-butoxy-5-t-octylthiophenol in 40 mL of dimethyl sulfoxide was heated on a steam bath 24 hr. while open to air. The cooled reaction mixture was poured into ice-water and the resulting cream-colored precipitate was removed by filtration and dried to yield 9.1 g tan soapy solid, m.p. 65°-66°, with the elemental analysis and nmr spectrum expected for Compound 1.

EXAMPLE 2

Preparation of Compounds 4-7

A solution of 125.2 g (1 mol) o-aminobenzenethiol in 500 mL dimethyl sulfoxide was heated on a steam bath 3 hr. while open to air. A second batch of 192 g (1.53 mol) of the thiol in 1.5 L dimethyl sulfoxide was similarly heated 1.5 hr. The combined reaction mixtures were poured into ice-water and the resulting precipitate removed by filtration. This crude product was purified by slurrying in 1.5 L warm methanol, cooling, filtering, and washing with cold methanol. On drying, a 99.1% pure light green solid melting at 88°-89° was obtained, having the expected elemental analysis and nmr spectrum for bis(2-aminophenyl)disulfide.

To a stirred, cold solution of 74.5 g (0.3 mol) of this intermediate diamino-disulfide in 200 mL dry tetrahydrofuran was added 92 g pyridine and then, dropwise under an argon atmosphere, 137.8 g (0.63 mol) lauroyl chloride. The reaction was run to completion by adding 220 mL tetrahydrofuran and 5 g pyridine and stirring 3 days in a warm water bath. The mixture was then stirred into ice-water 2 hr., removed by filtration, and dried. Recrystallization from ethanol and vacuum drying yielded 168.7 g white powder, m.p. 89°-91°, with an elemental analysis and nmr spectrum consistent with Compound 4.

The same diaminodiphenyl disulfide intermediate for Compound 4 was combined in a similar manner with other appropriate acid chlorides in place of lauroyl chloride to make Compounds 5, 6, and 7. The purity of each was checked by hplc and the structures were confirmed by elemental analysis and nmr spectra.

EXAMPLE 3

Image Dye Light Stabilization

Photographic elements were prepared by coating a gel-subbed, polyethylene-coated paper support with a photosensitive layer containing a silver bromoiodide emulsion at 0.215 g Ag/m$^2$, gelatin at 1.62 g/m$^2$, and the magenta image coupler at 0.38 mmol/m$^2$ indicated in Table 1 dispersed in an equal weight of tricresyl phosphate. Each coupler dispersion also contained the stabilizer compound shown in Table 1 along with the following compounds (amounts indicated as weight percent of coupler): Compound A (49%), Compound B (29%), Compound C (32%), Compound D (16%) and ethyl acetate (300%). The photosensitive layer was overcoated with a protective layer containing gelatin at 1.08 g/m$^2$ and bisvinylsulfonylmethyl ether hardener at 2 weight percent based on total gelatin.

Magenta Coupler M-1

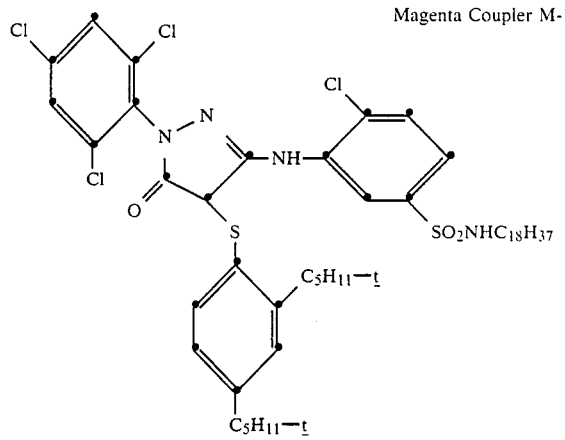

-continued

Magenta Coupler M-2

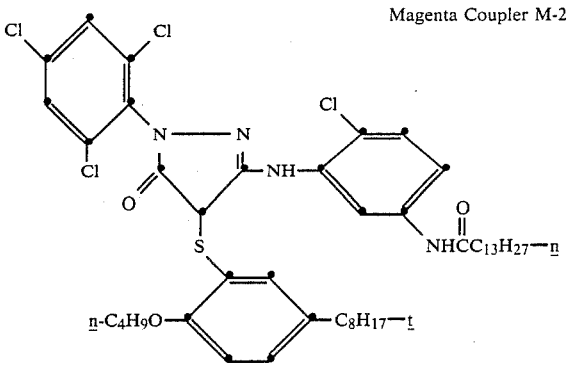

Compound A

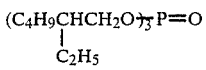

Compound B

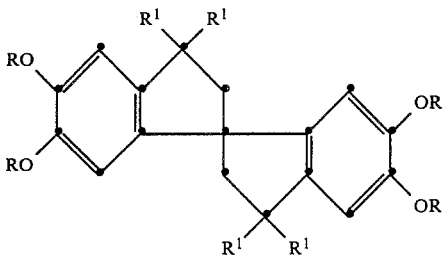

R = $-C_3H_7-n$
$R^1 = CH_3$

Compound C

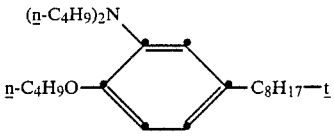

Compound D

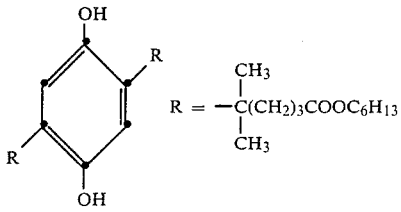

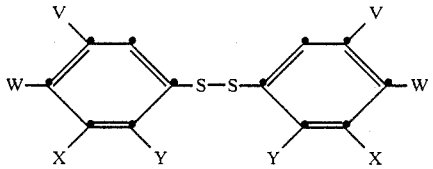

| | V | W | X | Y |
|---|---|---|---|---|
| Control 1 | H | H | H | H |
| Control 2 | H | H | H | Cl |
| Control 3 | H | Cl | H | H |
| Control 4 | H | H | H | $NO_2$ |
| Control 5 | H | H | H | $OCH_3$ |
| Control 6 | H | $OCH_3$ | H | H |

-continued

Control 7

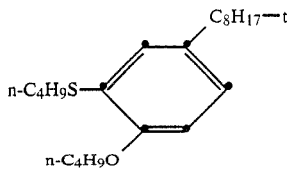

Samples of each element were imagewise exposed through a graduated-density test object, processed at 33° C. employing the color developer identified below for 3.25 minutes, then 1.5 minutes in the bleach-fix bath, washed and dried.

| | | |
|---|---|---|
| Color Developer (pH 10.08) | | |
| Triethanolamine | 11 | mL |
| Benzyl alcohol | 14.2 | mL |
| Lithium chloride | 2.1 | g |
| Potassium bromide | 0.6 | g |
| Hydroxylamine sulfate | 3.2 | g |
| Potassium sulfite (45% solution) | 2.8 | mL |
| 1-Hydroxyethylene-1,1-diphosphoric acid (60%) | 0.8 | mL |
| 4-Amino-3-methyl-N—ethyl-N—β-methanesulfonamido)ethylaniline sulfate hydrate | 4.35 | g |
| Potassium carbonate (anhydrous) | 28 | g |
| Stilbene whitening agent | 0.6 | g |
| Surfactant | 1 | mL |
| Water to make | 1.0 | liter |
| Bleach-Fix Bath (pH 6.8) | | |
| Ammonium thiosulfate | 104 | g |
| Sodium hydrogen sulfite | 13 | g |
| Ferric ammonium ethylenediamine tetraacetic acid (EDTA) | 65.6 | g |
| EDTA | 6.56 | g |
| Ammonium hydroxide (28%) | 27.9 | mL |
| Water to make | 1 | liter |

Dye images of replicate processed strips were then subjected to the following stability tests as indicated (A Wratten 2B filter removed the ultraviolet component in light fade tests):

HID—high intensity daylight, 50 Klux xenon
SANS—simulated average north skylight, 5.4 Klux xenon
W.O.—60° C./70% R.H. "wet oven", dark keeping
D.O.—77° C./5%.R.H. "dry oven", dark keeping The following results were obtained:

TABLE 1

| | | 1 Week HID Test | |
|---|---|---|---|
| Coupler | Stabilizer ($mg/m^2$) | Density Loss From D = 1.7 | Yellow Stain Increase |
| M-1 | None | −0.31 | 0.05 |
| M-1 | Control 1 (43) | −0.21 | 0.16 |
| M-1 | Control 2 (54) | −0.45 | 0.18 |
| M-1 | Control 3 (54) | −0.55 | 0.12 |
| M-1 | Control 4 (59) | −0.22 | 0.09 |
| M-1 | Control 5 (54) | −0.49 | 0.01 |
| M-1 | Control 6 (54) | −0.21 | 0.09 |
| M-1 | Compound 1 (113) | −0.09 | 0.03 |
| M-1 | Compound 2 (75) | −0.16 | 0.02 |
| M-1 | Compound 3 (97) | −0.14 | 0.02 |
| M-1 | Compound 4 (118) | −0.19 | 0.03 |
| M-1 | Compound 5 (97) | −0.11 | 0.05 |
| M-1 | Compound 6 (81) | −0.11 | 0.07 |
| M-1 | Compound 7 (86) | −0.11 | 0.05 |
| M-2 | None | −0.14 | 0.00 |
| M-2 | Control 2 (54) | −0.31 | 0.16 |

TABLE 1-continued

| Coupler | Stabilizer ($mg/m^2$) | 1 Week HID Test: Density Loss From D = 1.7 | 1 Week HID Test: Yellow Stain Increase |
|---|---|---|---|
| M-2 | Control 5 (54) | −0.25 | 0.00 |
| M-2 | Compound 1 (113) | −0.12 | 0.00 |
| M-2 | Compound 2 (75) | −0.18 | 0.00 |
| M-2 | Compound 3 (97) | −0.15 | 0.00 |
| M-2 | Compound 6 (81) | −0.11 | 0.01 |

TABLE 2

| Coupler | Stabilizer ($mg/m^2$) | Density Loss from D = 1.7: 2 Wk. HID | 12 Wk. SANS | 6 Wk. W.D. | 2 Wk. D.O. |
|---|---|---|---|---|---|
| M-1 | None | −0.61 | −0.35 | −0.01 | −0.00 |
| M-1 | Cont. 7 (129) | −0.54 | −0.29 | −0.05 | −0.02 |
| M-1 | Cmpd. 1 (113) | −0.26 | −0.17 | −0.02 | −0.02 |
| M-2 | None | −0.23 | −0.21 | −0.03 | −0.06 |

It can be seen from the data in Table 1 that use of the stabilizer compounds of the invention provides a magenta dye image derived from coupler M-1 with improved light stability and less formation of yellow background stain in most cases. The comparison disulfide compounds do not provide as much stabilization and some even lead to increased fading and stain.

Coupler M-2 provides a dye which is initially more stable than that obtained from Coupler M-1. The addition of compounds 1 and 6 improves this light stability.

The data in Table 2 show that the addition of stabilizer Compound 1 provides a magenta image with stability to heat, light, and humidity comparable to the image formed from Coupler M-2. Compound 1 is also superior to Control 7, a monosulfide of closely related structure, in providing dye image stability to light and humidity.

The invention has been described in detail with particular reference to preferred embodiments thereof, but it will be understood that variations and modifications can be effected within the spirit and scope of the invention.

What is claimed is:

1. A photographic element comprising a support having thereon at least one silver halide emulsion layer having associated therewith a dye-forming coupler and an image dye stabilizer compound having the formula:

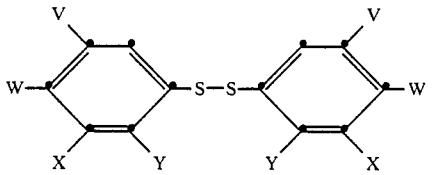

wherein each V, W, X and Y independently represents $R^1$, nitro, halogen, cyano, OR, SR, $NR^1R$, COR, COOR, $SO_3R$, $SO_2R$, NHCOR, $CONR^1R$, $NR^1SO_2R$, or $SO_2NR^1R$, or X or W can join together with an adjacent substituent to form a ring;

R represents a substituted or unsubstituted alkyl group of from 1 to about 20 carbon atoms; a substituted or unsubstituted aryl group of from about 5 to about 20 carbon atoms; cycloalkyl; or a substituted or unsubstituted heterocyclic group having from 3 to about 10 carbon atoms; and $R^1$ represents hydrogen or R;

with the proviso that the total number of carbon atoms within all V, W, X and Y groups combined is at least 4, and with the further proviso that at least one Y group is not hydrogen.

2. The element of claim 1 wherein said dye-forming coupler is a pyrazolone or a pyrazolotriazole which forms a magenta dye upon reaction with oxidized color developing agent.

3. The element of claim 1 wherein said coupler is a 2-equivalent magenta coupler and it is located together with said stabilizer compound in said silver halide emulsion layer.

4. The element of claim 1 wherein Y is OR and R is substituted or unsubstituted alkyl of from 1 to about 20 carbon atoms.

5. The element of claim 1 wherein Y is substituted or unsubstituted alkyl of from 1 to about 20 carbon atoms.

6. The element of claim 1 wherein Y is NHCOR or COOR.

7. The element of claim 1 wherein each V, W or X is either hydrogen or alkyl.

8. The element of claim 1 wherein said stabilizer compound is present at a concentration of at least about 50 $mg/m^2$.

9. In a process of stabilizing a photographic dye image against fading by light comprising exposing a photographic element comprising a support having thereon at least one silver halide emulsion layer having associated therewith a dye-forming coupler in the presence of an image dye stabilizer, and color developing said element to form a dye image, the improvement wherein said stabilizer is a compound having the formula:

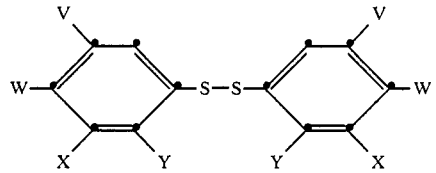

wherein each V, W, X and Y independently represents $R^1$, nitro, halogen, cyano, OR, SR, $NR^1R$, COR, COOR, $SO_3R$, $SO_2R$, NHCOR, $CONR^1R$, $NR^1SO_2R$, or $SO_2NR^1R$, or X or W can join together with an adjacent substituent to form a ring;

R represents a substituted or unsubstituted alkyl group of from 1 to about 20 carbon atoms; a substituted or unsubstituted aryl group of from about 5 to about 20 carbon atoms; cycloalkyl; or a substituted or unsubstituted heterocyclic group having from 3 to about 10 carbon atoms; and $R^1$ represents hydrogen or R;

with the proviso that the total number of carbon atoms within all V, W, X and Y groups combined is at least 4, and with the further proviso that at least one Y group is not hydrogen.

10. The process of claim 9 wherein said dye-forming coupler is a pyrazolone or a pyrazolotriazole which forms a magenta dye upon reaction with oxidized color developing agent.

11. The process of claim 9 wherein said coupler is a 2-equivalent magenta coupler and it is located together with said stabilizer compound in said silver halide emulsion layer.

12. The process of claim 9 wherein Y is OR, wherein R is substituted or unsubstituted alkyl of from 1 to about 20 carbon atoms.

13. The process of claim 9 wherein Y is substituted or unsubstituted alkyl of from 1 to about 20 carbon atoms.

14. The process of claim 9 wherein Y is NHCOR or COOR.

15. The process of claim 9 wherein each V, W or X is either hydrogen or alkyl.

16. The process of claim 9 wherein said stabilizer compound is present at a concentration of at least about 50 mg/m$^2$.

17. A processed photographic element comprising a support having thereon a dye image and an image dye stabilizer compound having the formula:

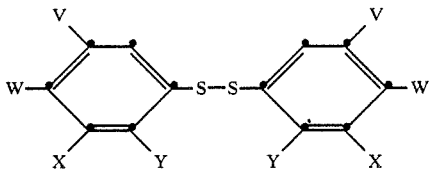

wherein each V, W, X and Y independently represents $R^1$, nitro, halogen, cyano, OR, SR, $NR^1R$, COR, COOR, $SO_3R$, $SO_2R$, NHCOR, $CONR^1R$, $NR^1SO_2R$, or $SO_2NR^1R$, or X or W can join together with an adjacent substituent to form a ring;

R represents a substituted or unsubstituted alkyl group of from 1 to about 20 carbon atoms; a substituted or unsubstituted aryl group of from about 5 to about 20 carbon atoms; cycloalkyl; or a substituted or unsubstituted heterocyclic group having from 3 to about 10 carbon atoms; and $R^1$ represents hydrogen or R;

with the proviso that the total number of carbon atoms within all V, W, X and Y groups combined is at least 4, and with the further proviso that at least one Y group is not hydrogen.

18. The element of claim 17 wherein Y is OR and R is substituted or unsubstituted alkyl of from 1 to about 20 carbon atoms.

19. The element of claim 17 wherein Y is substituted or unsubstituted alkyl of from 1 to about 20 carbon atoms.

20. The element of claim 17 wherein said stabilizer compound is present at a concentration of at least about 50 mg/m$^2$.

* * * * *